United States Patent [19]

Mierau et al.

[11] Patent Number: 4,685,497

[45] Date of Patent: Aug. 11, 1987

[54] KNIFE ARRANGEMENT FOR A WAFERIZER

[75] Inventors: Cameron D. Mierau, Clearbrook; Patrick J. Cramond, Coquitlam; Douglas C. Beer, Bellingham, all of Canada

[73] Assignee: CAE Machinery Ltd., Vancouver, Canada

[21] Appl. No.: 868,811

[22] Filed: May 29, 1986

[51] Int. Cl.[4] ..... B27C 7/10

[52] U.S. Cl. ..... 144/176; 144/241; 241/92; 407/58

[58] Field of Search ..... 241/92, 189 R, 298; 407/42, 114, 58; 144/172, 162 R, 174, 176, 241

[56] References Cited

U.S. PATENT DOCUMENTS

| | | | |
|---|---|---|---|
| 3,032,281 | 5/1962 | Wexell | 241/92 |
| 3,701,187 | 10/1972 | Erkfritz | 407/58 |
| 3,882,912 | 5/1975 | Sybertz | 407/58 |
| 4,068,976 | 1/1978 | Friedline | 407/114 |
| 4,260,002 | 4/1981 | Schmalz et al. | 144/241 |
| 4,298,044 | 11/1981 | Hansel et al. | 144/241 |

FOREIGN PATENT DOCUMENTS

| | | | |
|---|---|---|---|
| 2914093 | 10/1980 | Fed. Rep. of Germany | 144/241 |
| 140994 | 4/1980 | German Democratic Rep. | 407/58 |

*Primary Examiner*—W. D. Bray

*Attorney, Agent, or Firm*—Townsend & Townsend

[57] ABSTRACT

A waferizing apparatus having a rotatable disc. There are knife carriers mounted on the disc with spaced openings between the carriers. Openings in the disc correspond to the openings in the carrier and there is a knife associated with each opening. A knife clamp is bolted to the carrier to clamp each knife in position. Each knife clamp is urged resiliently inwardly against the carrier to clamp each knife in position in the apparatus. An expandable device can expand to separate the clamp and the carrier to permit removal of each knife.

9 Claims, 9 Drawing Figures

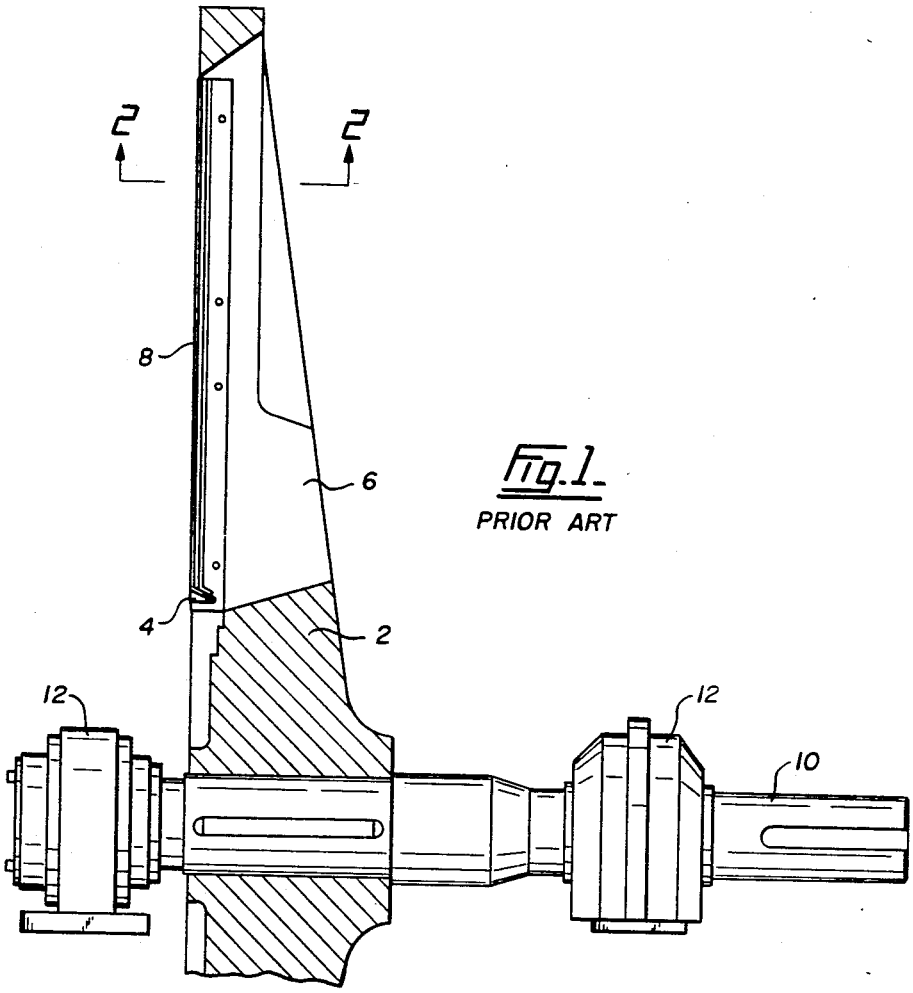
Fig. 1.
PRIOR ART
Fig. 2.
PRIOR ART
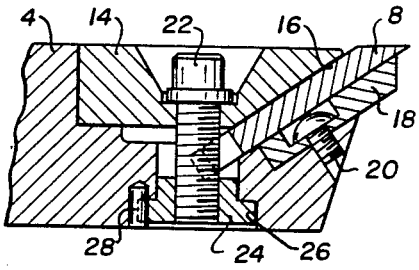
Fig. 3b.
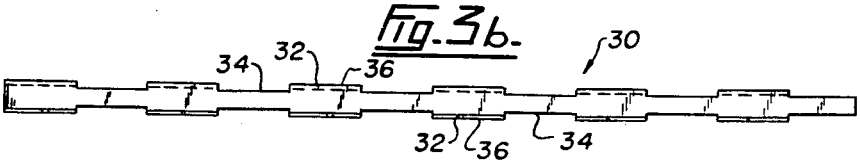

Fig. 3a.
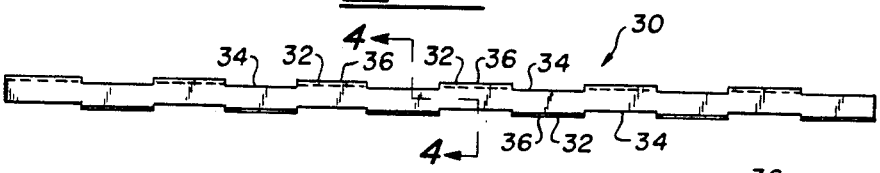
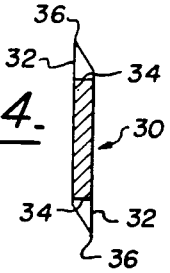
Fig. 4.
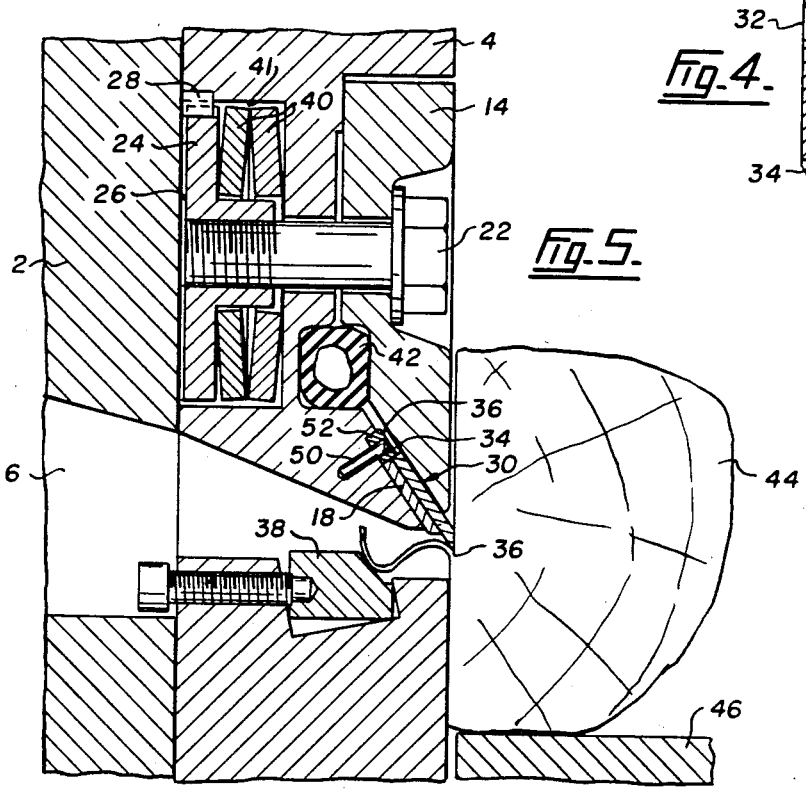
Fig. 5.
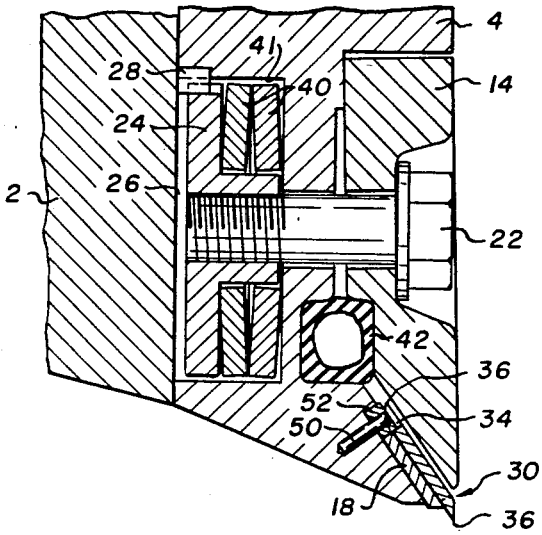
Fig. 6.

KNIFE ARRANGEMENT FOR A WAFERIZER

FIELD OF THE INVENTION

This invention relates to a waferizing apparatus and to a knife useful in waferizing apparatus.

DESCRIPTION OF THE PRIOR ART

Waferizing apparatus, that is apparatus to produce wafers from wood for use in the production of wafer board, are extremely well known. They resemble wood chippers in appearance but differ in the product they are designed to produce. Chippers cut wood across the grain to produce chips for the production of wood pulp. Waferizers cut the wood substantially parallel to the grain to produce wafers or flakes.

Waferizing apparatus generally comprises a large rotating disc or drum mounted on a driven shaft. The disk or drum has openings formed in it. On one surface is mounted a carrier for the waferizing knives which are disposed in the openings of the passageways. The knives are located in position by clamps contacting their planar surfaces. Clamps are usually located in position by bolting through into a threaded insert located within a recess in the carrier, on the surface of the carrier remote from the clamps. The knife typically has a counter knife disposed beneath it, that is against the carrier, and the knife and counter knife are bolted in position. U.S. Pat. No. 4,346,744 issued Aug. 31, 1982 indicates the prior art although that patent is specifically concerned with the provision of a reactor guide means on a side of the passageway through the disc, opposite the cutter knife.

As the disc rotates the knives, which project from the outer surface, that is beyond the clamps and the carrier, cut through wood pieces that are pressed against the carrier so that they may be converted to wafers.

The condition of the waferizer knives is extremely important and their grinding is very important if good wafer quality is to be achieved. Wafers are generally only about 0.025" thick and there is therefore little margin for poor knife grinding. A typical wafer board plant employs two persons grinding, honing and rebabbitting the knives. These are skilled activities in a plant that requires few other skills.

SUMMARY OF THE INVENTION

The present invention therefore seeks to simplify waferizing apparatus by providing a disposable knife and by greatly simplifying the securing, and thus replacement, of the cutting knives.

Accordingly, in a first aspect the present invention is waferizing apparatus having a rotatable disc, upon which are fixed carriers, spaced openings between the carriers; and matching spacings in the disc; a knife associated with each opening; a knife clamp bolted to the carrier to clamp each knife in position and comprising resilient means urging each knife clamp inwardly against the carrier to clamp each knife in position in the apparatus and expandable means expandable to separate the clamp and the carrier to permit removal of each knife.

In a further aspect the invention is a waferizing knife comprising an elongate body; serrations on each longitudinal edge of the elongate body, the serrations comprising projections and recesses; cutting edges formed on each projection. The projections on one edge may be staggered in relation to those on the other edge or they may be opposite each other.

DRAWINGS

Aspects of the invention are illustrated, merely by way of example, in the accompanying drawings in which:

FIG. 1 is a detail of a prior art waferizer;

FIG. 2 is also a detail of the prior art showing particularly the knife location;

FIGS. 3*a* and 3*b* illustrate disposable knives according to the present invention;

FIG. 4 is a section on the line 4—4 in FIG. 3;

FIG. 5 is a section through the apparatus according to the present invention;

FIG. 6 illustrates a detail of the FIG. 5 apparatus; and

Figure 7:
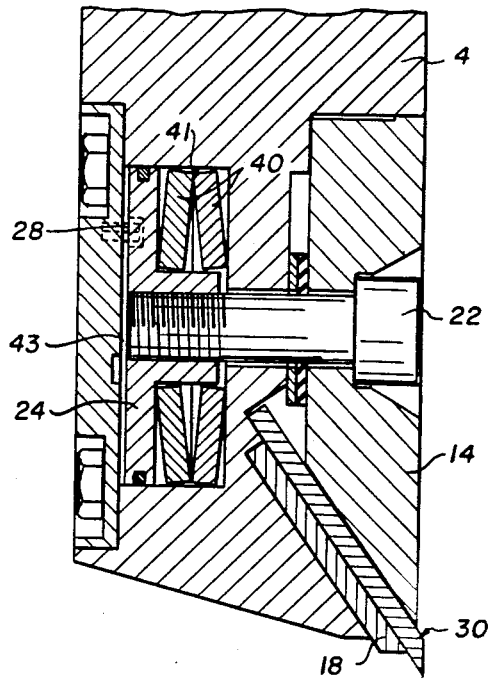
Figure 8:
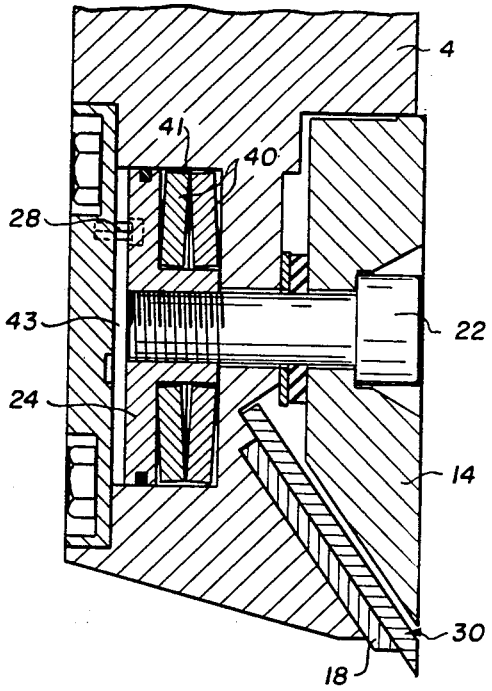

FIGS. 7 and 8 illustrate a further embodiment of the invention.

DESCRIPTION OF THE PREFERRED EMBODIMENTS

Referring first to FIGS. 1 and 2, illustrating the prior art, they show a waferizing apparatus having a disc 2 and rotatable carrier 4 with spaced openings 6 extending through them. There is a knife 8 associated with each opening 6 clamped to the carrier 4. The disc 2 is mounted on a rotatable shaft 10 carried by bearings 12. Although not shown in FIGS. 1 and 2 the disc 2 rotates so that knives 8 are brought into contact with a piece of wood—see FIG. 5.

As shown particularly in FIG. 2 the knife clamp arrangement typically comprises a clamp 14 having an inclined surface 16 to abut the knife 8. The knife 8 is mounted on a counter knife 18 located in position by bolts 20. A clamping bolt 22 engages threaded member 24 received within a recess 26 in the carrier 4. A pin 28 is provided to prevent rotation of the threaded member 24. By tightening bolts 22 into threaded members 24 the clamp 14 is forced into contact with the assembly of the knife 8 and the counter knife 18 to clamp the knife assembly to the carrier 4.

All of the above is conventional in the art.

The present invention seeks to simplify greatly first the mounting of the knives and, secondly, the maintenance of the knives.

As illustrated particularly in FIG. 3*a* the knife 30 according to one aspect of the present invention comprises an elongate body having serrations on longitudinal edges. The serrations comprise projections 32 and recesses 34. As shown particularly in FIG. 4 cutting edges 36 are formed on each projection 32 and the projections on one edge may be staggered in relation to those on the other edge, as shown in FIG. 3*a*, or aligned, as in FIG. 3*b*.

In a waferizing apparatus an A knife is a knife with cutting edges or projections 32 extending to the outer edge of the knife and with a recess 34 at the inner edge, adjacent the center of the disc. A B knife is the opposite arrangement. In a B knife there is a recess at its outer end and a cutting edge at its innermost end. Thus the FIG. 3*a* embodiment has both A and B type knives. Taking the right hand side of FIG. 3*a* as the outermost edge, the lower edge of the knife is an A knife and the upper edge is a B knife. It can be seen that rotation about the longitudinal axis of the knife changes an A knife to a B knife and vice versa.

In the FIG. 3*b* embodiment, depending on which edge is outermost, the knife remains an A knife or a B knife when rotated about its longitudinal axis.

In both embodiments, that of FIG. 3*a* and that of FIG. 3*b*, the cutting edges are on opposite thickness faces, as shown especially in FIG. 4, so that a cutting edge is properly presented when the knife is rotated about its longitudinal axis. Typically the knives will be arranged so that A and B knives are in alternate knife pockets. When the knives are dull the machine is stopped and each blade rotated to bring a sharp edge into use. On rotation of each knife about its longitudinal axis the FIG. 3*a* knives each change from A to B or B to A to maintain the alternate arrangement of A and B knives. The FIG. 3*b* embodiment remains an A knife or a B knife.

The knife of FIGS. 3*a* and 4 is particularly suitable for use with the apparatus of FIGS. 5 and 6 although such a knife can also be used in a conventional waferizer. However the apparatus according to the present invention, as shown in FIGS. 5 and 6, is particularly advantageous in that it greatly simplifies the location of the knife 30 and decreases the time and effort required to change knives.

In FIGS. 5 and 6 the same reference numerals are used, where appropriate, as in FIGS. 1 and 2. It should also be noted that FIG. 5 shows the use of a reactor knife or guide 38 on an opposite side of the passageway 6 from the knife 30. This is an extremely useful feature of a wood waferizing apparatus and is the subject of the above U.S. Pat. No. 4,346,744. It forms no part of the present invention.

As shown in FIGS. 5 and 6 the apparatus of the present invention has resilient means in the form of disc springs 40, also known as Belleville washers, located in a plurality of recesses 41, only one of which is shown in each of FIGS. 5 and 6, in the carrier 4, remote from the clamping members 14. The recesses 41 in the carrier are such that without the Belleville washers 40 the threaded member 24, and the receiving bolt 22, can move freely in the recess 26, in a direction longitudinal to the bolt 22. The presence of pin 28 prevents its rotation within the recess 26. When bolts 22 are tight the Belleville washers 40 urge each clamp 14 inwardly against the carrier 4 to clamp each knife 30 in position in the apparatus.

The apparatus also includes expandable means in the form of a hydraulic hose 42 that is expandable to separate the clamping members 14 and the carrier 4 to permit removal of each knife 30. The removal position, that is the expanded position of the hydraulic hose 42, is shown in FIG. 6. Hydraulic fluid is pumped into and from the hydraulic hose 42 using a conventional hydraulic pump (not shown). The hose 42 is located between the clamping member 14 and the carrier 4 so that expansion of the hydraulic hose 42 tilts the clamp, against the urging of the Belleville washers 40, outwardly to the FIG. 6 position.

In contrast to the arrangement shown in FIGS. 1 and 2 the apparatus according to the present invention includes a spring pin 50 and a knife gauge bar 52 engaging the spring pin 50. The knife gauge bar 52, engaged on the spring pin 50, acts to control the projection of the knife 30 from the face of the waferizer above the carrier 4, and thus, of course, the wafer thickness. The arrangement is such that by changing the gauge bar 52 for a narrower or wider bar the projection of the knife 30 can be changed. The arrangement is simple to operate. When the knife 30 is removed the gauge bar 52 can be disengaged from the spring pin 50 and a different gauge bar inserted. The gauge bar 52 forms a seat for the recessed parts 34 of the knives 30.

To use the apparatus of the present invention first, with the apparatus at rest, a double-edged knife 30 as shown in FIG. 3*a* or 3*b* is selected, the appropriate gauge bar and the apparatus moved to the FIG. 6 position, that is hydraulic fluid is pumped into the hydraulic hose 42 to move the clamping members 14 outwardly, against the urging of the Belleville washers 40, which tend to move threaded member 24, and thus the bolt 22 and thus the clamp 14, inwardly, that is forcing the clamp 14 against the carrier 4. The gauge bar and the knife 30 are placed in position and hydraulic pressure then released so that the FIG. 5 position is assumed. That is in the absence of hydraulic pressure in the hydraulic hose 42 the Belleville washers force the threaded member 24 inwardly, acting on bolt 22 and thus on clamp 14, to force the knife 30 into position against the counter knife 18.

The apparatus is used as in FIG. 5. That is a log 44, supported on surface 46 is cut by rotation of the disc in conventional manner. It will be appreciated that FIG. 5 shows a merely diagrammatic arrangement of the wood 44 and its support surface 46. As indicated the apparatus is used precisely as the prior art waferizer.

When the knife 30 is dulled the apparatus is stopped and hydraulic pressure then applied to the hose 42, so that the clamping member 14 tilts to the FIG. 6 position. The disposable knife 30 is removed from the apparatus, the apparatus is blown clear of dust, shavings and the like, the blade 30 is turned and replaced in the space between the counter knife 18 and the clamp 14. If necessary a fresh gauge bar may be inserted. Hydraulic pressure is released and the waferizer is then ready to use. Two, three or four knife assemblies can be pressurized at any one time. That is two, three or four knives 30 can be changed at any one time.

Once the blade 30 has been dulled on both sides it can simply be thrown away, thus eliminating the time-consuming and expensive practise of grinding, honing and rebabbitting.

FIGS. 7 and 8 show a further embodiment of the apparatus of the present invention. In the embodiment of FIGS. 7 and 8 the same reference numerals are used, where appropriate, as in FIGS. 5 and 6. However the embodiment of FIGS. 7 and 8 differs from that of the embodiment of FIGS. 5 and 6 by the means to receive a fluid. In the embodiment of FIGS. 7 and 8 the means to receive a fluid comprises a manifold 43 communicating with a recess 41. Threaded member in the recess is formed as a piston fit within the recess 41. To facilitate such a fit the piston may be provided with a piston ring, for example an O-ring, at its periphery. Pin 28 is present to prevent rotation of the threaded member within the recess 41. FIG. 7 illustrates the clamp position. FIG. 8 the unclamped position with fluid pressure applied. The means to apply fluid pressure may be a pump, as in the FIGS. 5 and 6 embodiment and, again, is not shown. The apparatus is provided with a steel washer and an elastic washer to seal the recess from infiltration of dirt and water.

The lock position is shown as FIG. 7. In that position no fluid pressure is applied through the manifold 43 and the Belleville washers 40 act against threaded member to clamp the knife 30 and the counter-knife 18 in position. However when hydraulic pressure is applied, the piston in the form of a threaded member 24 is moved inwardly in recess 41 as shown in FIG. 8. The knife may then be removed.

In use as a waferizer the apparatus is used precisely as in the previous embodiment.

The present invention thus provides a disposable, double-edged knife that produces excellent wafers and yet does not necessitate expensive grinding and sharpening. Furthermore the knife is particularly suitable for the apparatus of the present invention because of the simple and efficient means of locating the knife and, in particular, the speed with which knives can be changed in the illustrated apparatus.

I claim:

1. In a waferizing apparatus having a rotatable disc;
knife carriers mounted on the disc;
spaced openings between the carriers;
openings in the disc corresponding to the openings in the carrier;
a knife associated with each opening;
a knife clamp bolted to the carrier to clamp each knife in position the improvement comprising:
resilient means urging each knife clamp inwardly against the carrier to clamp each knife in position in the apparatus; and
means to receive a fluid under pressure and movable, upon receipt of the fluid under pressure, to separate the clamp and the carrier to permit removal of each knife.

2. Apparatus as claimed in claim 1 in which the resilient means comprises Belleville washers.

3. Apparatus as claimed in claim 2 including a plurality of recesses in the carrier, remote from the clamps, each to receive a threaded member that, in turn, receives a knife clamp bolt, the Belleville washers being positioned to abut the threaded member and the carrier to tend to urge the threaded member away from the carrier, thus tending to urge the clamp towards the carrier.

4. Apparatus as claimed in claim 3 including means to prevent rotation of the threaded member in each recess.

5. Apparatus as claimed in claim 1 in which the means to receive a fluid under pressure comprises a hydraulic hose communicating with a hydraulic pump whereby fluid can be pumped to the hose to expand it.

6. Apparatus as claimed in claim 5 in which the hose is located between the clamp and the carrier whereby expansion of the hose urges the clamp and carrier apart to allow withdrawal of the knife.

7. Apparatus as claimed in claim 3 in which the means to receive a fluid comprises a manifold, communicating to a recess;
the threaded member in the recess being formed as a piston fit within the recess; whereby the application of fluid under pressure to the manifold acts against the Belleville washer to release the clamp.

8. Apparatus as claimed in claim 1 including a piston ring to facilitate the piston fit of the threaded member within the recess.

9. Apparatus as claimed in claim 1 in which each knife is a doubled-edged knife formed with a plurality of serrations on each longitudinal edge.

* * * * *